United States Patent [19]

Sokoler et al.

[11] Patent Number: 4,509,306

[45] Date of Patent: Apr. 9, 1985

[54] PANEL FOR SELF-SUPPORTING ROOF STRUCTURES COMPRISING ELONGATED EXTRUDED PROFILE ELEMENTS OF PLASTICS MATERIAL CLOSED AT THEIR ENDS, AND CLOSING MEMBER FOR SUCH PROFILE ELEMENTS

[75] Inventors: Henryk Sokoler, Roskilde; Eigil Pedersen, Jyllinge, both of Denmark

[73] Assignee: Everlite A/S, Skaevinge, Denmark

[21] Appl. No.: 512,341

[22] Filed: Jul. 25, 1983

[30] Foreign Application Priority Data

Aug. 12, 1982 [DK] Denmark ..... 3621/82

[51] Int. Cl.[3] ..... E04B 1/70

[52] U.S. Cl. ..... 52/302; 52/200; 52/309.1; 52/586; 126/445

[58] Field of Search ..... 52/306, 588, 586, 302, 52/301, 303, 200, 305, 244; 220/242, 241, 307; 138/89; 126/445

[56] References Cited

U.S. PATENT DOCUMENTS

| | | | |
|---|---|---|---|
| 3,578,027 | 5/1971 | Zopfi | 220/352 |
| 4,163,496 | 8/1979 | Dogliotti | 220/306 |
| 4,197,687 | 4/1980 | Benoit | 52/303 |
| 4,212,291 | 7/1980 | Erb | 126/445 |
| 4,445,542 | 5/1984 | Fouss | 138/94 |

FOREIGN PATENT DOCUMENTS

| | | | |
|---|---|---|---|
| 2103853 | 4/1972 | Fed. Rep. of Germany | 52/586 |
| 2742659 | 3/1979 | Fed. Rep. of Germany | 126/445 |
| 1401279 | 4/1965 | France | 52/309.1 |
| 1098681 | 1/1968 | United Kingdom | 52/586 |
| 1511189 | 5/1978 | United Kingdom | 52/309.1 |

*Primary Examiner*—Henry E. Raduazo

*Attorney, Agent, or Firm*—Stevens, Davis, Miller & Mosher

[57] ABSTRACT

A panel for self-supporting roof structures of extruded profile elements having at least one main duct closed at the ends with closing members (10) which are made of plastics material and have the same profile as the profile elements and is closed at one end (17). The closing member (10) is of so reduced dimensions as to fit into any main duct in the profile element while allowing some air exchange without the risk of penetration of dirt.

The closing member (10) has preferably resilient sealing flaps (12, 13, 14, 15) on two opposite sides, so that one and the same member (10) can be used for closing profile elements of varying size and shape, e.g. as a result of manufacturing inaccuracies. A V-shaped groove encircles the outer surface of the closing member and permits movement of the two parts of a bipartite flap.

8 Claims, 3 Drawing Figures

PANEL FOR SELF-SUPPORTING ROOF STRUCTURES COMPRISING ELONGATED EXTRUDED PROFILE ELEMENTS OF PLASTICS MATERIAL CLOSED AT THEIR ENDS, AND CLOSING MEMBER FOR SUCH PROFILE ELEMENTS

BACKGROUND OF THE INVENTION

This invention relates to a panel for self-supporting roof structures of the type comprising elongated extruded, preferably translucent, profile elements of plastics material, in particular polycarbonate, each having at least one main duct and on the outer sides coupling members for securing one profile element side by side to adjacent similar profile elements so as to form a continuous surface requiring support only along two opposite ends. Such panels may have an intermediate wall dividing the main duct of the profile element into two subducts disposed in succession in the direction from the inner side of the outer side of the profile element.

Prior art profile elements of the type in question are shown by way of example in the British Pat. Nos. 901,935 and 1,511,189 and a development of such elements is disclosed in the co-pending application Ser. No. 300 510.

A self-supporting roof made of such profile elements possesses good insulating properties, especially when the ducts are closed at their ends, which is normally done by means of small blocks of insulating material cut so as to fit into the ducts. The insulating material prevent free air circulation but allow some air exchange. This closing method presents a number of disadvantages. Even when choosing an insulating material of a colour matching that of the profile element so that it is only slightly noticeable, it becomes dirty after some time and spoils the appearance of the roof. Furthermore, the material is exposed to damage and may fall out under the action of variable loads and fluctuations of temperature.

SUMMARY OF THE INVENTION

It is an object of the present invention to eliminate the said drawbacks in structures composed of profile elements or panels, e.g. roof structures, and to provide a closure which is easily manufactured and inserted and does not deteriorate in the course of time.

According to the invention the closing member is made of plastics material and has substantially the same profile as the wall of said profile element defining said main duct and with such dimensions that the closing member fits into the duct and substantially prevents free air circulation through said duct.

By this construction is also obtained a strengthening of the ends of the profile elements or panels, i.e. of those parts of the elements which are most exposed to damage due to thrust. Further, the total cost of manufacturing and mounting of the closing members is reduced, as it will generally be possible to mount them in the factory so that the ducts are closed during the transport of the elements and their storage on the building site and therefore not exposed to becoming dirty inwardly, which would require troublesome additional cleaning prior to delivery.

Even if the closing member is made of the same material as the profile elements or of another plastics material having suitable properties, it can be difficult to achieve a sufficiently accurate fit between the two parts due to the tolerance transgressions which are unavoidable in an extrusion process. The obvious solution consisting in the choice of outer dimensions of the closing member corresponding to the largest duct opening in the profile elements within the range of tolerance is not practical because it renders difficult or impossible the assembling operations in the cases where the dimensions of the duct opening lie in the lower end of the tolerance range, and it gives rise to an irregular sealing degree in the different ducts. Another solution consisting in manufacturing a number of closing members having different dimensions within the tolerance range is costly and complicated and requires a larger stock.

In accordance with another aspect of the invention, these drawbacks are remedied by providing the closing member outwardly along two opposite lateral surfaces which are the insertion of the member in the duct of the profile element are to abut against substantially plane lateral surfaces in said element, with resilient sealing flaps disposed across the surface and facing the open end of the closing member. Besides acting as sealing members the flaps act also as a kind of barbs and ensure that the closing member is kept in correct position in the end of the profile element.

In a particularly advantageous embodiment of the closing member according to the invention, each of the sealing flaps is divided by a narrow slit into two parts placed in continuation of one another, said slit being so dimensioned as to be able to close when a pressure is exerted on the closing member for pressing said member into the duct of the profile element. By designing the closing member with a V-shaped groove encircling the outer surface of the closing member and disposed mainly in its medium plane, a controlled resiliency is achieved so that the flaps are guided to overlap. These embodiments are remarkable in that they can be used as closing members in the so-called three-layers- three-ducts profiles in which the middle main duct has two opposite plane sides, whereas each of the two adjoining ducts has a plane side and an opposite side having two plane parts forming an obtuse angle with one another. Such a profile element is described in the co-pending patent application Ser. No. 300 510. Regardless of the different sectional shapes of the three ducts in one and the same profile element, the described closing member provides in all essentials the same sealing degree and the same friction and thereby the same resistance to accidental falling out e.g. during transport and assembling.

BRIEF DESCRIPTION OF THE DRAWINGS

In the following the invention will be explained in greater detail with reference to the accompanying schematic drawings where.

DESCRIPTION OF THE PREFERRED EMBODIMENT

Figure 1:
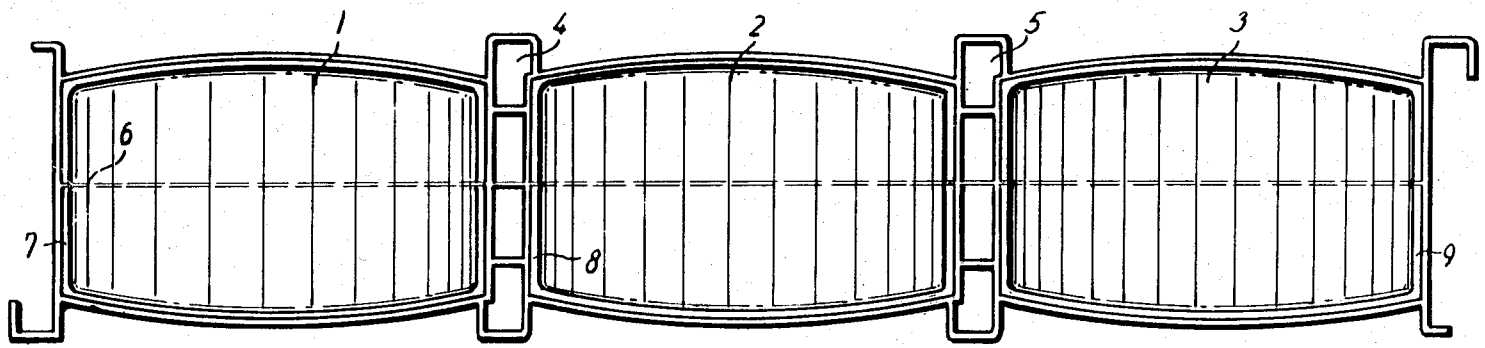
FIG. 1 is a front plan view of an embodiment of a profile element having three main ducts, each of them closed with a closing member.

The profile element shown in FIG. 1 has three main ducts 1, 2, 3 separated two by two by secondary ducts 4 and 5, each of the main ducts being divided into two half-ducts by a thin intermediate wall 6 shown in double dashed lines.

Figure 2:
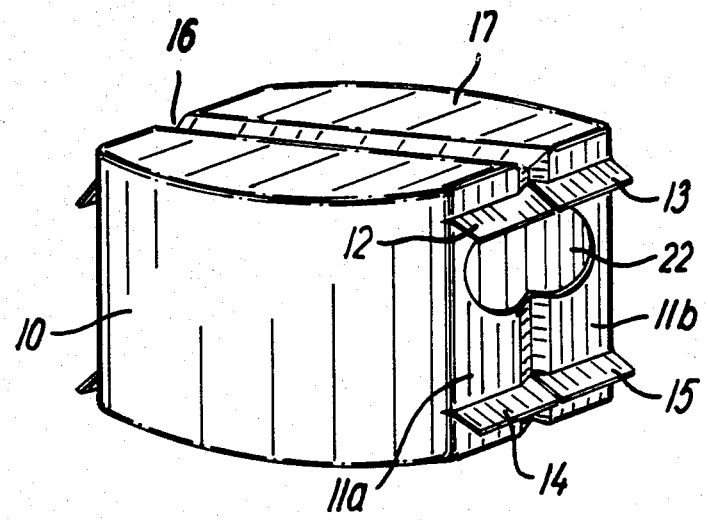
FIG. 2 is a perspective view of an embodiment of a closing member according to the invention.

In the main ducts 1, 2 and 3 the intermediate wall 6 is cut away at both ends of the profile element so as to allow the insertion of closing members 7, 8 and 9 which may, for instance, be designed as shown in FIG. 2. The external cross-section of the closing members corresponds to the internal cross-section of the main ducts and said members are closed at the bottom, thus forming a bowl-shaped body having a depth adapted to the purpose. If the purpose is just to close the duct, only a low depth is needed together with a suitably tight fit for preventing the closing member from falling out, even when it is not welded or glued to the wall of the duct.

In the embodiment of a closing member 10 according to the invention as shown in FIG. 2, two opposite plane lateral surfaces, of which only one, designated 11*a* and 11*b*, is shown in the figure, are each provided with four resilient flaps 12, 13, 14 and 15, disposed two and two, 12, 13 and 14, 15 respectively, in continuation of one another, the pairs being separated by a narrow slit. The flaps form integral parts of the member and are manufactured together with this, e.g. by casting in a suitable mould. The slits are situated in the median plane of the closing member and aligned with a V-shaped groove 16 which extends over the two substantially plane outer lateral surfaces of the closing member and over the bottom face 17 facing upwards in the figure. The groove 16 separates the two halves 11*a* and 11*b* of the lateral surface visible in FIG. 2. If a pressure is exerted along opposite edges of the lateral surface 11*a* and 11*b*, as is the case where the closing member is pressed into a duct of the profile element, the slit will close and the flaps will overlap due to the fact that the angle of the V-shaped groove becomes more acute during the compression.

Figure 3:
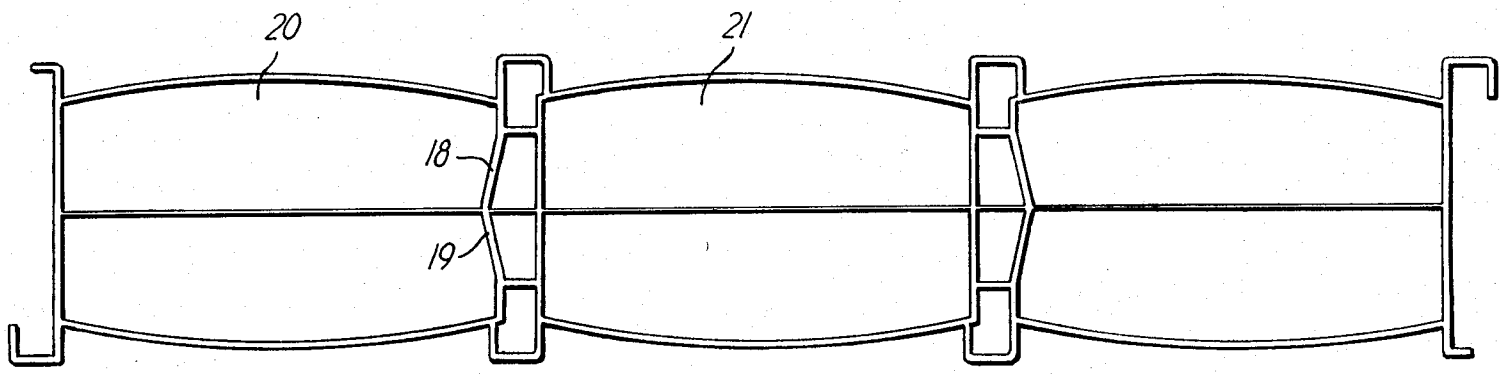
FIG. 3 is a front plan view of another embodiment of a profile element having three main ducts of two different cross sections but without a closing member in place.

The angle is chosen preferably of approximately the same size as the angle between the two lateral parts 18 and 19 of the wall of the duct 20 of FIG. 3. The flaps afford the necessary sealing, whether the closing member is used in the duct 20 or the duct 21 in which the two opposite lateral surfaces are plane.

The closing member may in two opposite lateral surfaces be provided with preferably oblong openings 22 for a through anchor bar which, for instance, can have a circular cross-section and fit into corresponding openings in the profile elements.

The closing member 10 is pressed into the main duct, e.g. 1, of the profile element with the closed bottom 17 first so that the flaps 12, 13, 14 and 15 act as barbs resisting withdrawal when the closing member has reached the correct position in which the open end is in alignment with the edge of the end of the profile element.

The closing member is in the drawing shown with convex surfaces corresponding with the internal and external surfaces of the profile elements but the invention is not limited to such shape.

We claim:

1. A panel for self-supporting roof structures of the type comprising elongated extruded profile elements of plastics material each having at least one main duct and on the outer sides coupling members for securing one profile element side by side to adjacent similar profile elements so as to form a continuous surface requiring only support along two opposite ends; a closing member of plastics material at each end of each main duct and of substantially the same profile as the wall of said profile element defining said main duct and with such dimensions that the closing member fits into the duct and substantially prevents free air circulation through said duct, resilient sealing flaps along and issuing from two opposite lateral outer surfaces of said closing member, the free ends of the flaps facing the open end of the closing member; each sealing flap extending over said lateral surface and being divided into two parts by a narrow slit which is closed when the closing member is in position in the end of the profile element.

2. A panel as claimed in claim 1, in which each of the two lateral surfaces is provided with two sealing flaps spaced apart in the axial direction.

3. A panel as claimed in claim 1, in which a V-shaped groove in the surface of the closing member encircles the outer face substantially in the median plane of said member.

4. A panel as claimed in claim 1, in which the closing member has two corresponding openings for receiving an anchor bar one in each of the two opposite sides carrying the flaps.

5. A closing member of plastics material for closing a main duct in an elongated extruded profile element for a panel for roof structures which closing member has substantially the same profile as the wall of said profile element defining said main duct and with such dimensions that the closing member can fit into said main duct and substantially prevent free air circulation through said duct and which closing member further has resilient sealing flaps along and issuing from two opposite lateral outer surfaces of said closing member, the free ends of the flapes facing the open end of the closing member; each sealing flap extending over said lateral surface and being divided into two parts by a narrow slit which is closed when the closing member is in position in the end of the profile element.

6. A closing member as claimed in claim 5, in which each of the two lateral surfaces is provided with two sealing flaps spaced apart in the axial direction.

7. A closing member as claimed in claim 5, in which a V-shaped groove in the surface of the closing member encircles the outer face substantially in the median plane of said member.

8. A closing member as claimed in claim 5, in which there are two corresponding openings for receiving an anchor bar one in each of the two opposite sides carrying the flaps.

* * * * *